US006628081B2

(12) United States Patent
Behr et al.

(10) Patent No.: US 6,628,081 B2
(45) Date of Patent: Sep. 30, 2003

(54) ELECTRIC LAMP

(75) Inventors: Gerhard Behr, Altheim (DE); Peter Helbig, Sontheim (DE)

(73) Assignee: Patent-Treuhand-Gesellschaft fuer elektrische Gluehlampen mbH, Munich (DE)

( * ) Notice: Subject to any disclaimer, the term of this patent is extended or adjusted under 35 U.S.C. 154(b) by 0 days.

(21) Appl. No.: 10/138,248

(22) Filed: May 6, 2002

(65) Prior Publication Data

US 2002/0163288 A1 Nov. 7, 2002

(30) Foreign Application Priority Data

May 4, 2001 (DE) ..... 101 21 608

(51) Int. Cl.[7] ..... H01J 13/46

(52) U.S. Cl. ..... 315/56; 362/226; 362/549; 439/619; 439/699.2; 313/318.09; 313/318.1

(58) Field of Search ..... 315/56, 77, 82; 362/226, 267, 519, 548, 549; 313/49–51, 315, 317, 318.01, 318.04, 318.07, 318.09, 318.1, 318.12, 578; 439/611, 617–619, 699.2, 702

(56) References Cited

U.S. PATENT DOCUMENTS

| | | | | | |
|---|---|---|---|---|---|
| 4,305,637 | A | * | 12/1981 | Grewcock et al. | 439/615 |
| 5,010,272 | A | * | 4/1991 | Eckhardt et al. | 313/579 |
| 5,239,226 | A | * | 8/1993 | Seredich et al. | 313/318.01 |
| 5,428,261 | A | * | 6/1995 | Wittig et al. | 313/318.1 |
| 5,957,569 | A | | 9/1999 | Helbig et al. | 362/263 |
| 6,075,318 | A | * | 6/2000 | Noll et al. | 313/573 |
| 6,328,455 | B1 | * | 12/2001 | Helbig | 362/226 |

FOREIGN PATENT DOCUMENTS

DE 0 815 578 1/1996

* cited by examiner

*Primary Examiner*—Haissa Philogene
(74) *Attorney, Agent, or Firm*—William E. Meyer

(57) ABSTRACT

An electric lamp, in particular a motor vehicle auxiliary light lamp, and a method for producing such a lam. The base of the lamp comprises an annular metal part (5) or resilient design for holding the lamp vessel (1), and a plastic part (6) provided with at least one hollow contact pin (7, 8). A supply lead (3, 4) projecting from the lamp vessel (1) is threaded into the hollow contact pin (7, 8) and welded to the latter such that the metal part (5) is under mechanical stress. In this way, backlash-free plug-and-socket connections are produced between the lamp vessel (1) and the metal part (5) or between the metal part (5) and the plastic part (6).

8 Claims, 3 Drawing Sheets

ELECTRIC LAMP

I. TECHNICAL FIELD

Figure 1:
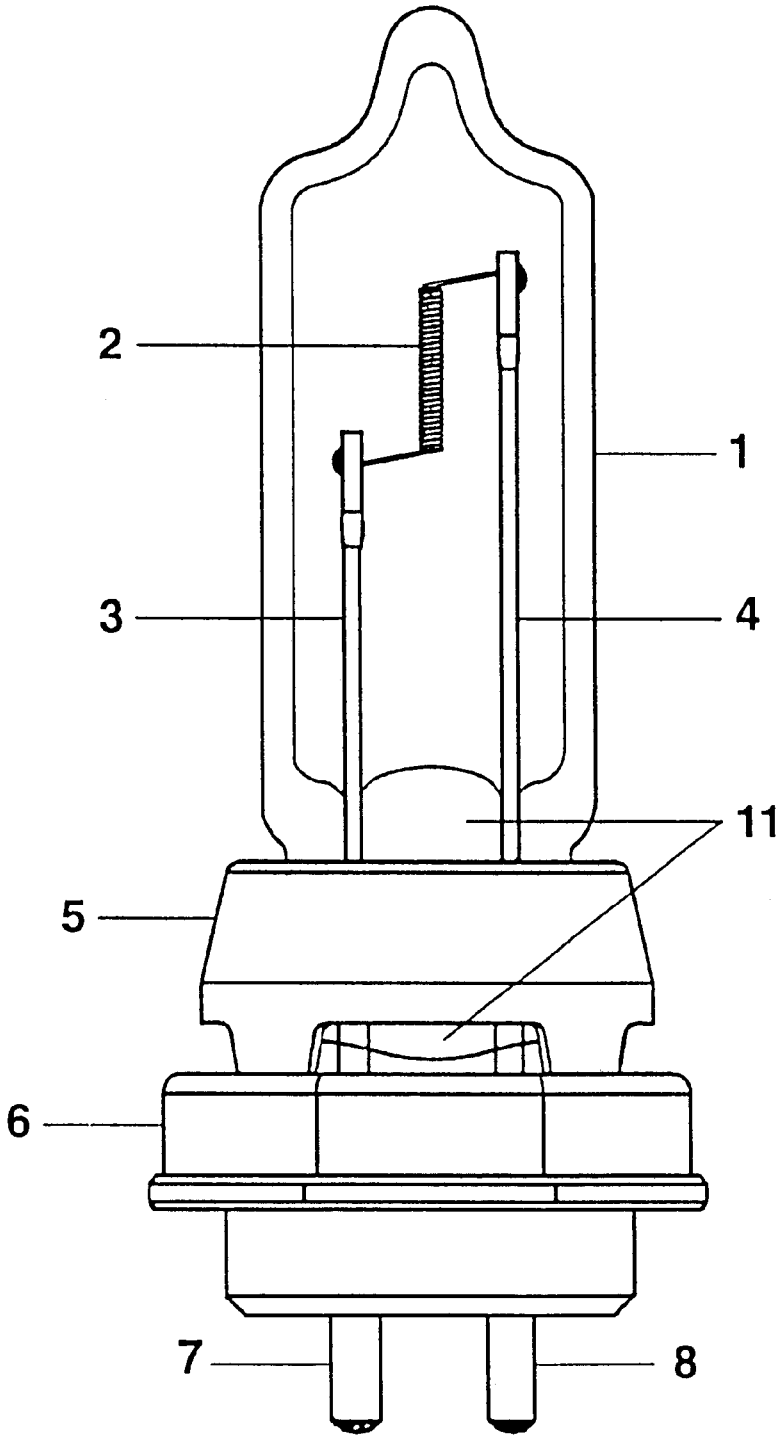

The invention relates to an electric lamp in accordance with the preamble of patent claim 1.

II. BACKGROUND ART

Such an electric lamp is disclosed, for example, in European Patent EP 0 815 578 B1. This patent describes a motor vehicle headlamp which has a lamp vessel with an incandescent filament arranged therein, supply leads for the incandescent filament and a lamp base, the lamp base having a metal ring for holding the lamp vessel and a plastic part provided with electric terminals.

III. DISCLOSURE OF THE INVENTION

It is the object of the invention to provide an electric lamp, in particular a motor vehicle auxiliary light lamp such as, for example, a brake light lamp or a direction indicator light lamp, with a simplified base, and to specify a method for producing such a lamp.

According to the invention, this object is achieved by the features of claim 1 and claim 6, respectively. Particularly advantageous embodiments of the invention are described in the dependent claims.

As regards a motor vehicle auxiliary light lamp, no such high demands are placed on the alignment of the luminous element—incandescent filament or discharge arc—with reference to the reflector as is the case with a motor vehicle headlamp. The base design for an auxiliary light lamp can therefore be correspondingly simplified.

The base of the electric lamp according to the invention has an annular metal part of resilient design for holding the lamp vessel, and a plastic part provided with electric terminals, the lamp vessel forming a plug-and-socket connection with the metal part or/and the metal part forming a plug-and-socket connection with the plastic part. At least one electric terminal is designed as a hollow contact pin in which one end of a supply lead projecting from the lamp vessel and serving to supply energy to the at least one luminous element is arranged and fixed. Owing to the resilient configuration of the metal part, the exertion of pressure on the plug-and-socket connection or the plug-and-socket connections can produce in the metal part a mechanical stress that can be maintained by fixing the supply lead in the hollow contact pin. The entire structure of the base is thus held together in a backlash-free arrangement and clamped seat by the connection of supply lead and hollow contact pin. There is no need for any further components to provide the lamp according to the invention with a base.

In order to hold the lamp vessel, the metal part is advantageously equipped with a plurality of integrally formed guide webs and depth-control stops. The spring action of the metal part can be produced advantageously and simply with the aid of the depth-control stops. The plug-and-socket connection between the metal part and the plastic part is advantageously produced by means of a plurality of lugs which are integrally formed on the metal part and can be plugged into fitting slots or cutouts in the plastic part.

In order to anchor the at least one hollow contact pin securely in the plastic part, the contact pin is preferably of cylindrical design and has a bead that enlarges its outside diameter, and a section widened in the shape of a funnel. The funnel-shaped section also serves additionally as a threading aid for the end of the supply lead arranged in the hollow contact pin.

The method according to the invention for producing an electric lamp comprises the work steps of:

providing a prefabricated lamp vessel having at least one luminous element arranged therein and supply leads projecting from the lamp vessel, providing a prefabricated, annular metal part of resilient design.

The method is characterized in that a prefabricated plastic part provided with electric terminals is provided, at least one electric terminal being designed as a hollow contact pin, a plug-and-socket connection is produced between the lamp vessel and the annular metal part of resilient design or/and between the annular metal part of resilient design and the plastic part such that the free end of a supply lead is threaded in the at least one hollow contact pin, and pressure is exerted on the plug-and-socket connection or on the plug-and-socket connections such that the metal part is under mechanical stress and during this time the free end of the supply lead is welded or soldered to the at least one hollow contact pin.

This ensures a backlash-free clamped seat of the lamp vessel, metal part and plastic part. The mechanical stress is produced in a simple way and advantageously by means of a plurality of depth-control stops for the lamp vessel that are integrally formed on the metal part. For the purpose of producing the plug-and-socket connection with the plastic part, the metal part advantageously has a plurality of integrally formed lugs that are introduced into fitting depressions in the plastic part. Before the production of the plug-and-socket connection or the plug-and-socket connections, one end of the hollow contact pin is advantageously widened in the shape of a funnel in order to ease the threading of the supply lead into the hollow contact pin and to ensure that the contact pin is securely anchored in the plastic part.

IV. BRIEF DESCRIPTION OF THE DRAWINGS

Figure 2:
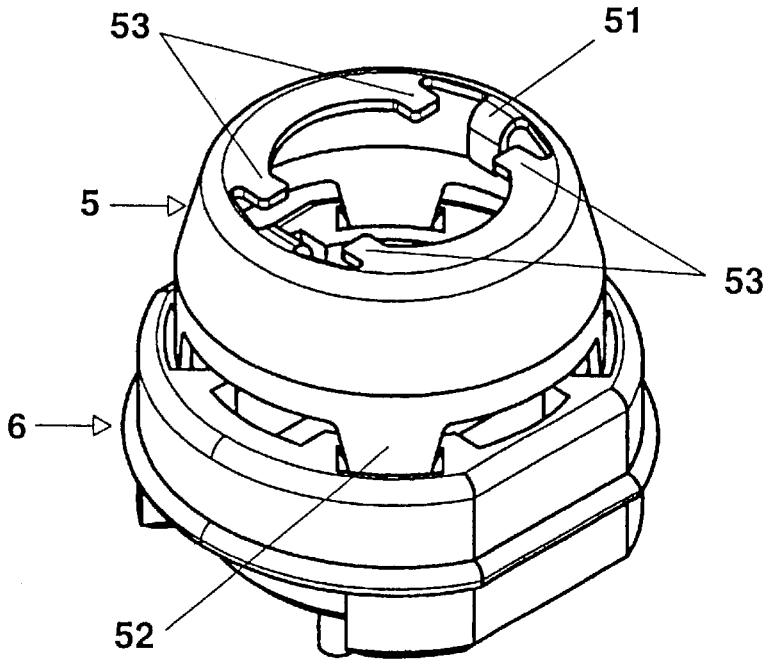
Figure 3:
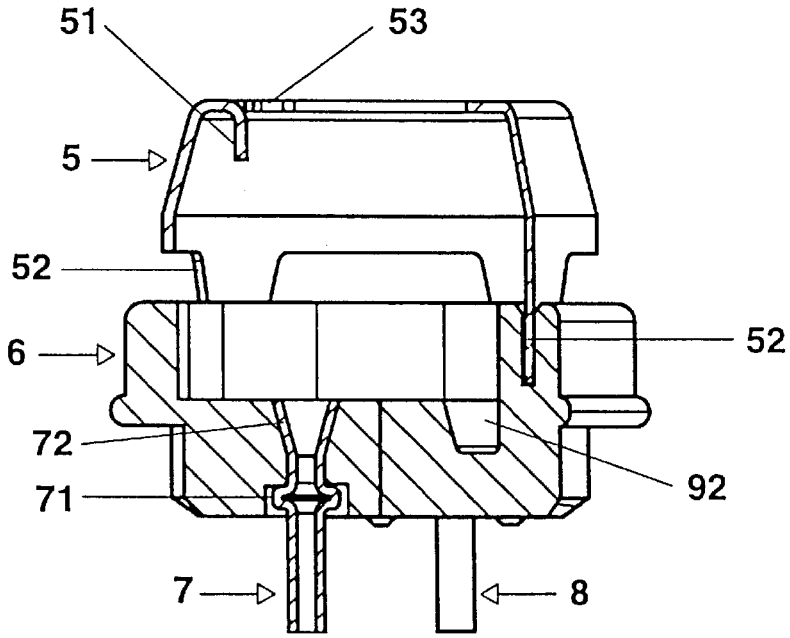
Figure 4:
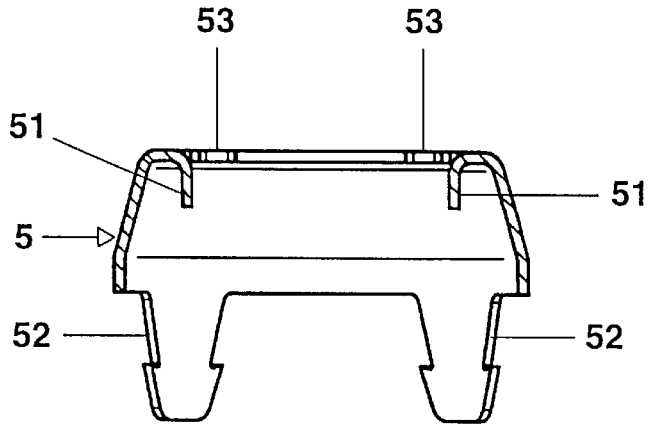
Figure 5:
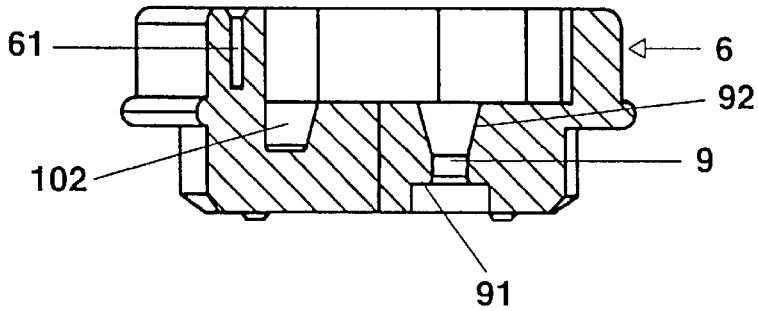
Figure 6:
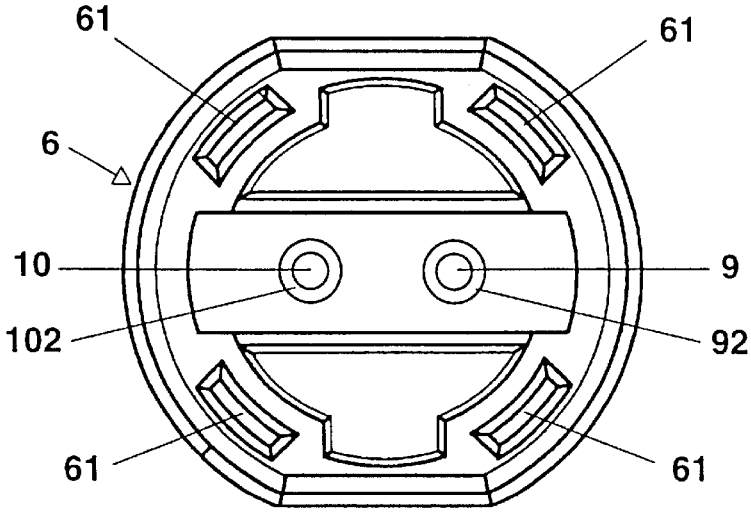

The invention is explained in more detail below with the aid of a preferred exemplary embodiment. In the drawing:

FIG. 1 shows a side view of the lamp in accordance with the preferred exemplary embodiment of the invention, FIG. 2 shows an isometric illustration of the plug-and-socket connection of the metal part and plastic part of the lamp illustrated in FIG. 1, FIG. 3 shows a cross section through the plug-and-socket connection, illustrated in FIG. 2, between the metal part and plastic part, FIG. 4 shows a cross section through the metal part of the lamp according to the invention, as illustrated in FIG. 1, FIG. 5 shows a cross section through the plastic part of the lamp according to the invention, as illustrated in FIG. 1, and FIG. 6 shows a plan view of the plastic part of the lamp according to the invention, as illustrated in FIG. 1.

V. BEST MODE FOR CARRYING OUT THE INVENTION

The preferred exemplary embodiment of the electric lamp according to the invention is an incandescent lamp with an electric power consumption of approximately 19 W and a nominal voltage of 12 V. This lamp is provided for use in a motor vehicle as brake light or direction indicator light. FIG. 1 shows a schematic of this incandescent lamp.

The incandescent lamp has a lamp vessel 1 made from glass which is sealed in a gastight fashion by means of a press stem 11. An incandescent filament 2 is arranged in the axial direction in the interior of the substantially cylindrical lamp vessel 1. The ends of the incandescent filament 2 are each connected in an electrically conducting fashion to a supply lead wire 3, 4. The supply lead wires 3, 4, which serve to supply energy to the incandescent filament 2, are guided out of the lamp vessel 1 via the press stem 11. The base of the lamp comprises an annular metal part 5 and a plastic part 6 which are both connected to one another by a plug-and-socket connection. The press stem 11 of the lamp vessel 1 is held in the metal part 5 by means of a plug-and-socket connection. This purpose is served by the guide webs 51, integrally formed on the metal part 5, which bear against the narrow end faces of the press stem 11, and the depth-control stops 53 integrally formed on the metal part 5, which on the one hand bear against the broad sides of the press stem 11 and on the other hand form a supporting surface, arranged at right angles to the axis of the lamp vessel, for the hollow part, widened by comparison with the press stem 11, of the lamp vessel 1. The guide webs 51 and the depth-control stops 53 support the press stem 11 of the lamp vessel on all sides without, however, producing a clamped seat of the press stem 11 in the annular metal part 5.

The plastic part 6 is equipped with the electric terminals 7, 8 of the lamp. The electric terminals 7, 8 are both designed as hollow contact pins. The free ends of the two supply lead wires 3, 4 are each arranged in one of the hollow contact pins 7 and 8, respectively, and welded there to the contact pins 7 and 8, respectively. Details of the design of the base are illustrated in FIGS. 2 to 6.

The annular metal part 5 has four lugs 52 arranged equidistantly along its circumference. The lugs 52 respectively engage in slots 61, coordinated to fit therein, in the plastic part 6. The lugs 52 and the slots 61 form the plug-and-socket connection between the metal part 5 and the plastic part 6 of the lamp base. The metal part 5 is of resilient design. The plastic part 6 has two cutouts 9, 10 in which in each case a hollow contact pin 7 and 8, respectively, is anchored. The hollow contact pins serve the lamp as electric terminals. The contact pins 7, 8 each have a bead 71 that enlarges their outside diameter, and a section 72 widened in the shape of a funnel. The bead 71 and the funnel-shaped section 72 ensure that the respective contact pin 7 or 8 is securely anchored in the cutouts 9, 10. The cutouts 9, 10 each have a stop 91 for the bead 71 and a region 92, 102, widened in the shape of a funnel, for the funnel-shaped section 72 of the corresponding contact pin 7 and 8, respectively. The two supply leads 3, 4 extend in each case as far as into one of the hollow contact pins 7 and 8, respectively. The funnel-shaped section 72 of the corresponding contact pin 7 or 8 serves as a threading aid for the end of the supply lead 3 and 4, respectively. The metal part 5 consists of stainless steel or German silver, and the plastic part 6 is designed as an injection-molded part.

In order to provide the lamp with a base, the prefabricated lamp vessel 1 including the incandescent filament 2 mounted therein and the supply leads 3, 4, the prefabricated metal part 5 and the prefabricated plastic part 6 are jointed, that is to say mounted with one another by means of plug-and-socket connections. When the metal part 5, the lamp vessel 1 and the plastic part 6 are being joined, the free ends of the supply leads 3, 4 are introduced into the hollow contact pins 9, 10. Subsequently, pressure is exerted on the plug-and-socket connections in the axial direction such that a mechanical stress is produced in the metal part 5 and, in particular, in the depth-control stops 53. While the metal part 5 or the depth-control stops 53 are under mechanical stress, the ends of the supply leads 3, 4 arranged in the hollow contact pins 8, 9 are welded to the contact pins 9, 10. The plug-and-socket connections are fixed undetachably and with a clamped seat by means of the welded connections between the contact pins 9, 10 and the supply leads 3, 4, as well as by the mechanical stress maintained in the metal part 5.

The invention is not restricted to the preferred exemplary embodiment explained in more detail above. For example, there is no need for both electric terminals to be designed as hollow contact pins. It suffices for at least one electric terminal to be designed as a hollow contact pin.

Moreover, the guide webs 51 can also be designed in such a way that they bear in a clamping or resilient fashion against the press stem 11 of the lamp vessel 1. In this case, the plug-and-socket connection between the metal part 5 and the plastic part 6 is first and foremost fixed in a fashion free from backlash and undetachably by the welded connection of the supply leads to the contact pins with the metal part 5 under mechanical stress.

On the other hand, it would also be possible to anchor the metal part 5 in the plastic part 6 by means of injection-molding technology, and to fix the plug-and-socket connection between the lamp vessel 1 and the metal part 5 in a fashion free from backlash and undetachably by the welded connection 3, 4 of the supply leads to the hollow contact pins 7, 8 with the metal part 5 under mechanical stress.

What we claim is:

1. An electric lamp with a transparent lamp vessel (1) having at least one luminous element (2) enclosed in the lamp vessel (1), having supply leads (3, 4), projecting from the lamp vessel (1), for supplying energy to the at least one luminous element (2), and having a lamp base, the lamp base having an annular metal part (5) for holding the lamp vessel (1) and a plastic part (6) provided with electric terminals (7, 8), the electric terminals (7, 8) being connected in an electrically conducting fashion to one of the supply leads (3, 4) in each case, wherein the metal part (5) is of resilient design, the lamp vessel (1) forms a plug-and-socket connection with the base, at least one of the electric terminals (7, 8) is designed as a hollow contact pin, and one end of a supply lead (3, 4) extending through a passage in the base is arranged in the at least one hollow contact pin (7, 8), said hollow pin being trapped adjacent the base, the lead being connected under tension to this contact pin (7, 8).

2. The electric lamp as claimed in claim 1, wherein the hollow contact pin (7, 8) is of cylindrical design and has a bead (71) with a widened outside diameter as well as a section (72) widened in the shape of a funnel.

3. An electric lamp with a transparent lamp vessel (1) having at least one luminous element (2) enclosed in the lamp vessel (1), having supply leads (3, 4), projecting from the lamp vessel (1), for supplying energy to the at least one luminous element (2), and having a lamp base, the lamp base having an annular metal part (5) for holding the lamp vessel (1) and a plastic part (6) provided with electric terminals (7, 8), the electric terminals (7, 8) being connected in an electrically conducting fashion to one of the supply leads (3, 4) in each case, wherein the metal part (5) is of resilient design, the lamp vessel (1) forms a plug-and-socket connection with the base, at least one of the electric terminals (7, 8)is designed as a hollow contact pin, and one end of a supply lead (3, 4) is arranged in the at least one hollow contact pin (7, 8) and connected to this contact pin (7, 8), and, wherein the metal part (5) has lugs (52), and the plastic part (6) has depressions (61) for holding the lugs (52).

4. The electric lamp as claimed in claim 1, wherein the metal part (5) has guide webs (51) for the lamp vessel (5) and depth-control stops (53) of resilient design for the lamp vessel (5).

5. A method for producing an electric lamp, the method comprising the following steps:

providing a prefabricated lamp vessel (1) having at least one luminous element (2) arranged therein and supply leads (3, 4) projecting from the lamp vessel (1), providing a prefabricated, annular metal base part (6) of resilient design, wherein a prefabricated plastic part (6) provided with electric terminals (7, 8) is provided, at least one electric terminal (7, 8) being designed as a hollow contact pin, a plug-and-socket connection is produced between the lamp vessel (1) and the base such that the free end of a supply lead (3, 4) is threaded in the at least one hollow contact pin (7, 8), and pressure is exerted on the plug-and-socket connection or on the plug-and-socket connections such that the metal part (5) is under mechanical stress and during this time the free end of the supply lead (3, 4) is welded or soldered to the at least one hollow contact pin (7, 8).

6. The method as claimed in claim 5, wherein the mechanical stress is produced by means of a plurality of depth-control stops (53) for the lamp vessel (1), which are integrally formed on the metal part (5) and are of resilient design.

7. The method as claimed in claim 5, wherein an end of the hollow contact pin (7, 8) is widened in the shape of a funnel before the production of the plug-and-socket connection or the plug-and-socket connections.

8. An electric lamp with a transparent lamp vessel (1) having at least one luminous element (2) enclosed in the lamp vessel (1), having supply leads (3, 4), projecting from the lamp vessel (1), for supplying energy to the at least one luminous element (2), and having a lamp base, the lamp base having an annular metal part (5) for holding the lamp vessel (1) and a plastic part (6) provided with electric terminals (7, 8), the electric terminals (7, 8) being connected in an electrically conducting fashion to one of the supply leads (3, 4) in each case, wherein the metal part (5) is of resilient design, the lamp vessel (1) forms a plug-and-socket connection with the base, at least one of the electric terminals (7, 8) is designed as a hollow contact pin, and one end of a supply lead (3, 4) is arranged in the at least one hollow contact pin (7, 8) and connected to this contact pin (7, 8), and wherein the metal part (5) has guide webs (51) for the lamp vessel (5) and depth-control stops (53) of resilient design for the lamp vessel (5).

* * * * *